US005876269A

United States Patent [19]

Torii

[11] Patent Number: 5,876,269

[45] Date of Patent: Mar. 2, 1999

[54] APPARATUS AND METHOD FOR POLISHING SEMICONDUCTOR DEVICE

[75] Inventor: Kouji Torii, Tokyo, Japan

[73] Assignee: NEC Corporation, Tokyo, Japan

[21] Appl. No.: 964,988

[22] Filed: Nov. 5, 1997

[30] Foreign Application Priority Data

Nov. 5, 1996 [JP] Japan ..... 8-292420

[51] Int. Cl.[6] ..... B24B 1/00; B24B 29/00

[52] U.S. Cl. ..... 451/41; 451/36; 451/59; 451/288; 451/533; 451/550

[58] Field of Search ..... 51/297, 298, 299; 451/36, 41, 59, 63, 285, 287, 288, 289, 290, 533, 534, 550

[56] References Cited

U.S. PATENT DOCUMENTS

| | | | |
|---|---|---|---|
| 3,863,395 | 2/1975 | Brown | 451/533 X |
| 4,132,037 | 1/1979 | Bonora | 451/288 |
| 5,184,433 | 2/1993 | Maack | 451/162 X |
| 5,257,478 | 11/1993 | Hyde et al. | 451/287 |
| 5,287,663 | 2/1994 | Pierce et al. . | |
| 5,534,106 | 7/1996 | Cote et al. | 451/533 X |
| 5,725,420 | 3/1998 | Torii | 451/285 |

FOREIGN PATENT DOCUMENTS

| | | |
|---|---|---|
| 0658401 | 6/1995 | European Pat. Off. . |
| 7-297195 | 11/1995 | Japan . |
| 2257382 | 1/1993 | United Kingdom . |

*Primary Examiner*—Timothy V. Eley
*Attorney, Agent, or Firm*—Sughrue, Mion, Zinn, Macpeak & Seas, PLLC

[57] ABSTRACT

The apparatus (method) for polishing semiconductor device is equipped with a polish pad which comprises an upper layer material and a lower layer material of differing degrees of hardness overlying one another, whereby a semiconductor wafer is polished while being pressed against the polish pad, the degree of hardness of the upper layer material of the polish pad being set at Shore spring A hardness 92–98.5, and the degree of hardness of the lower layer material of the polish pad at Shore spring A hardness 78–87.5.

12 Claims, 7 Drawing Sheets

APPARATUS AND METHOD FOR POLISHING SEMICONDUCTOR DEVICE

BACKGROUND OF THE INVENTION

1. Field of the Invention

The present invention relates to an apparatus and a method for polishing semiconductor device. More specifically it relates to an improvement in apparatus and method for polishing semiconductor device with respect to the hardness of the polish and back pads.

2. Description of the Related Art

In the manufacture of semiconductor devices it is normal for irregularities or unevenness to occur on the surface of the semiconductor wafer or substrate as a result, for example, patterning of MOS transistor active components or aluminum wiring. In other words, surface irregularities in the component area or along the aluminum wiring appear also as irregularities on the surface of the interlayer dielectric film which is formed on the semiconductor wafer. These surface irregularities affect the accuracy of processing dimensions during the later process of forming the upper-layer wiring, particularly in the lithography process.

Recent years have witnessed a reduction in wiring pitch and advances in multilayer wiring, as a result of which it has become vital to ensure that the surface of the semiconductor wafer is flat. Consequently, it has become impossible to satisfy the requirements for planarization in the process of manufacturing semiconductors by employing conventional methods of filling concave sections of the interlayer dielectric in with spin-on glass and similar flow coatings.

The principal method in use at present is known as chemical and mechanical polishing (CMP). FIG. 6 shows how a semiconductor wafer is polished using a conventional polishing apparatus. A soft material 51 and a hard material 52 are made to adhere in laminated fashion to the upper surface of a revolving platen 50, the soft material 51 acting as a soft pad and the hard material 52 as a hard pad, while together they constitute a polish pad. When a semiconductor wafer 53 is to be polished, an abrasive agent 54 is fed on to the abovementioned polish pad. The semiconductor wafer is fixed to the under surface of a spindle 55, its surface being polished by rotating the platen 50 and the spindle 55 in the same direction while applying a prescribed pressure in order to press on to the polish pad the exposed surface which is to be polished. This method is widely used for polishing interlayer dielectrics, component-separating films, metal films and other items.

FIG. 7 is a drawing which illustrates the conventional method for polishing a semiconductor wafer. It will be used to explain why the polish pad is composed of a double layer of soft material 51 and hard material 52. In this drawing, the dielectric film 56 of the semiconductor wafer 53 is shown pressed on to the polish pad consisting of the soft material 51 and hard material 52. In the drawing, 57 represents the wiring pattern which is covered by the dielectric film 56.

The application of various dielectric films 56 and metal films 57 to the semiconductor wafer 53 during the process of its manufacture means that when it comes to polishing, as the drawing shows, there is a degree of bowing which amounts to several tens of micrometers. Accordingly, surface distortion of the polish pad must be inhibited if selective polishing of convex sections of the dielectric films 56 and metal films 57 is to be attained. This is why a high degree of hardness is required. On the other hand, if the whole surface of the semiconductor wafer is to be polished uniformly, the polish pad must possess a degree of softness sufficient to offset the bowing. For this reason, and in order to achieve the twin aims of flatness and uniformity, the polish pad consists of a hard material (hard pad) 52 underlaid with a soft material (soft pad) 51.

Japanese Laid-Open Patent Application No. Hei7-297195 provides a specific example of conventional technology in relation to the polishing of semiconductor device. A double layer of polishing cloth comprising polyurethane unwoven cloth and hard foamed polyurethane is attached to a press platen. A tool covered in diamonds is applied to the under surface of the polishing cloth in order to raise the nap and shape the whole of the surface.

The technique described in the abovementioned patent normally employs Rodel-Nitta SUBA 400 (JIS spring A hardness 55–65, Shore spring A hardness 57.5–69) or Rodel SUBA IV (JIS spring A hardness 54–68, Shore spring A hardness 57–71) as the soft material which constitutes the lower layer of the polish pad (soft pad) 51. Meanwhile, Rodel IC 1000 (JIS spring A hardness 95, Shore spring A hardness 98) is employed as the hard material which constitutes the upper layer of the polish pad (hard pad) 52.

Here, JIS spring A hardness refers to the hardness as measured by means of a JIS spring type A according to the criteria described in Japanese Industrial Standards (JIS) K 6301. Shore spring A hardness signifies hardness as measured by means of a Shore spring type A. For the purpose of reference, FIG. 10 correlates the two.

However, the polish pad described in the abovementioned patent suffers from the drawback that when used to polish the semiconductor wafer 53, the rate of polishing falls in the vicinity of the center of the semiconductor wafer 53, and falls markedly in an area within a certain distance (e.g. 6 mm) of its outermost periphery. This occurs as a result of the low degree of hardness of the soft material 51 which forms the lower layer of the pad.

FIG. 8 shows how the polish pad becomes distorted as a result of the load imposed on it by the semiconductor wafer 53 in a conventional example. During polishing, as will be seen, the semiconductor wafer 53 is held by a guide ring 58. A base plate 59 is employed in order to apply a load, and the shape of the semiconductor wafer 53 is controlled by means of a back pad 60 while it is pressed against the polish pad comprising the hard material 52 and the soft material 51.

In the abovementioned method for polishing, the hard quality of the hard material 52 which forms the upper layer of the polish pad means that if its surface is distorted in a downward direction, the shape of that surface is incapable of following the curvature at the edges of the semiconductor wafer 53, as the drawing shows. The result is that the maximum load is exerted on these edges, so that localised distortion occurs in their vicinity. Consequently, not only is contact pressure reduced markedly in an area within a specified distance (e.g. 2–3 mm) of the edges, but contact pressure between the central part of the semiconductor wafer 53 and the polish pad is also reduced. This phenomenon occurs because an unnecessarily soft material is selected for use in the soft pad 51 which forms the lower layer of the polish pad, and makes it difficult to create semiconductor components within a specified distance (e.g. 6 mm) of the outermost periphery of the semiconductor wafer.

Recently, the method for polishing illustrated in FIG. 9 has been attempted with a view to solving the problems inherent in the abovementioned method. This improved method for polishing involves pressing against a polish pad comprising a soft material 51 and a hard material 52 a guide ring 81, the purpose of which is to hold the semiconductor wafer 53 during polishing. By allowing the area where the polish pad is subject to localised distortion to escape to the area outside the guide ring 81 (i.e., towards the periphery of the semiconductor wafer 53) it is possible to inhibit variation in the polishing rate in the vicinity of the outermost periphery of the semiconductor wafer 53.

However, the abovementioned improved conventional method for polishing requires the pressure with which the guide ring 81 is pressed against the polish pad to be at least equal to the polishing load which is exerted on the semiconductor wafer 53. This gives rise to unstable behaviour caused by attrition of the guide ring 81, disruption of the supply of the abrasive agent on to the polish pad by the guide ring 81, and variations in the optimal pressure on it as a result of changes in the polish pad with time. A further disadvantage accrues from the necessity for outlay in order to improve the polishing apparatus.

SUMMARY OF THE INVENTION

It is therefore an object of the present invention to provide improved CMP apparatus and CMP method.

It is another object of the present invention, which has been designed in view of the foregoing circumstances, by inhibiting reduction in the rate of polishing in the peripheral section of the semiconductor wafer not only to make it feasible to create semiconductor components to within a distance of about 2 mm of the outermost periphery of the semiconductor wafer, where this has hitherto been impossible within an area of (for instance) 6 mm of the outermost periphery, but also to provide an apparatus and a method for polishing semiconductor device which serve to increase the effective number of semiconductor chips per semiconductor wafer.

With a view to solving the abovementioned problem, there is provided according to a first aspect of the present invention an apparatus for polishing semiconductor device, being equipped with a polish pad which comprises an upper layer material and a lower layer material of differing degrees of hardness overlying one another, whereby semiconductor wafer is polished while being pressed against said polish pad, wherein the degree of hardness of the upper layer material of the polish pad is set at Shore spring A hardness 92–98.5, and the degree of hardness of the lower layer material of the polish pad at Shore spring A hardness 78–87.5.

In the foregoing, a mode is desirable wherein a buffer material of Shore spring A hardness 40–70 is located between a means of applying a load to the semiconductor wafer and the semiconductor wafer itself. Similarly, a mode is desirable wherein the hard material is foamed polyurethane of a specified thickness. Moreover, a mode is desirable wherein the soft material is unwoven cloth impregnated with polyurethane. Furthermore, a mode is desirable wherein the buffer material is polyurethane of a specified thickness.

According to a second aspect of the present invention there is provided a method for polishing semiconductor device, whereby semiconductor wafer is polished while being pressed against a polish pad which comprises an upper layer material and a lower layer material of differing degrees of hardness overlying one another, wherein the degree of hardness of the upper layer material of the polish pad is set at Shore spring A hardness 92–98.5, and the degree of hardness of the lower layer material of the polish pad at Shore spring A hardness 78–87.5.

In the foregoing second aspect, a mode is desirable wherein polishing is executed with a buffer material of Shore spring A hardness 40–70 located between a means of applying a load to the semiconductor wafer and the semiconductor wafer itself. Similarly, a mode is desirable wherein the hard material is foamed polyurethane of a specified thickness. Moreover, a mode is desirable wherein the soft material is unwoven cloth impregnated with polyurethane. Furthermore, a mode is desirable wherein the buffer material is polyurethane of a specified thickness. In addition, a mode is desirable wherein an abrasive agent is fed on to the upper surface of the polish pad, during which time semiconductor wafer is polished while being pressed against a polish pad which comprises an upper layer material and a lower layer material of differing degrees of hardness overlying one another. Also, a mode is desirable wherein the abrasive agent is fumed silica adjusted to pH 10–11 by virtue of its KOH content.

The foregoing first and second aspects make it possible to inhibit the phenomenon whereby the upper layer material in the polish pad is subject to localised distortion as a result of the load which is placed upon it by the outermost periphery of the semiconductor wafer. This is achieved by setting the hardness of the upper layer material of the polish pad at Shore spring A hardness 92–98.5, and that of the lower layer material at Shore spring A hardness 78–87.5.

It is thus possible to ensure that the rate of polishing in the vicinity of the outermost periphery of the semiconductor wafer is the same as that in the vicinity of the center thereof. This makes it possible to create semiconductor components closer to the periphery of the semiconductor wafer, thus increasing the effective number of semiconductor chips per semiconductor wafer, permitting of increased productivity.

By setting the degree of hardness of the lower layer material of the polish pad higher than hitherto (Shore spring A hardness 78–87.5), thus inhibiting the phenomenon whereby the upper layer material is subject to localised distortion as a result of the load which is placed upon it by the patterns and convex portions of the semiconductor wafer, it is possible to improve the planarization properties of the semiconductor wafer. This means that the amount of polishing can be reduced, permitting of further increased productivity.

BRIEF DESCRIPTION OF THE DRAWINGS

The above and other objects, advantages and features of the present invention will be more apparent from the following description taken in conjunction with the accompanying drawings, in which.

DESCRIPTION OF THE PREFERRED EMBODIMENTS

There follows, with the aid of drawings, a description of the best mode for implementing the invention. The description will center on two embodiments.

<First Embodiment>

Figure 1:
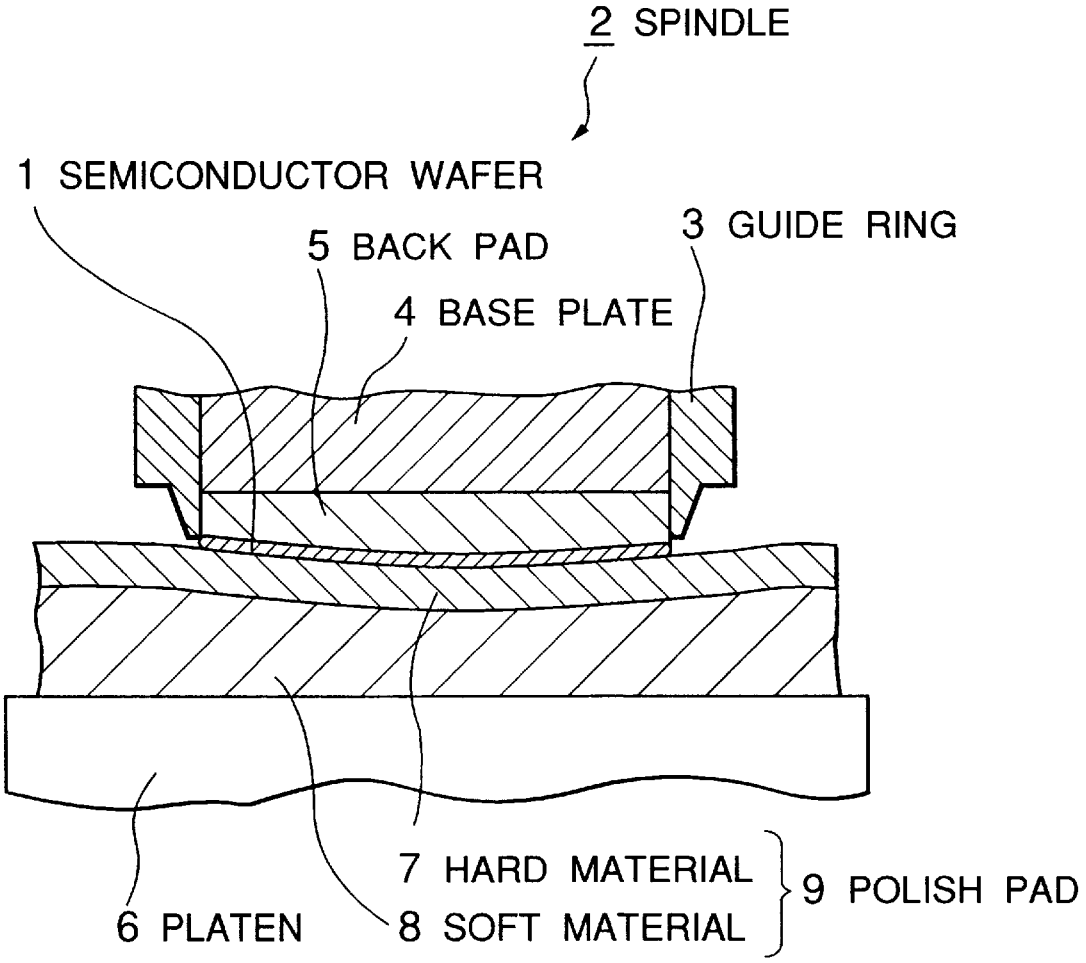
FIG. 1 is a longitudinal section showing the structure of the salient part of the apparatus for polishing semiconductor device which forms a first embodiment of the present invention.

FIG. 1 is a longitudinal section showing the structure of the salient part of the apparatus for polishing semiconductor device which forms the first embodiment of the present invention. In FIG. 1, a semiconductor wafer (silicon wafer) 1, which is to be polished, is held by a guide ring 3 which forms part of a spindle 2. The configuration is such that a load is applied by means of a base plate 4, which also forms part of the spindle 2, while the shape of the semiconductor wafer is controlled by a back pad 5. The load applied by the abovementioned base plate 4 causes the semiconductor wafer 1 to be pressed against a polish pad 9, which comprises a hard material 7 and a soft material 8 attached to a platen 6 in such a manner as to overlie one another, thus allowing the process of polishing to be implemented.

The degree of hardness of the hard material 7 which constitutes the upper layer of the polish pad 9 is set at Shore spring A hardness 97–98.5 (JIS spring A hardness 95 or thereabouts), while the degree of hardness of the soft material 8 which constitutes the lower layer of the polish pad 9 is set at Shore spring A hardness 78–87.5 (JIS spring A hardness 75–85). An example of a material which may be used as the hard material 7 is foamed polyurethane with a thickness of about 1.3 mm. Similarly, an example of a material which may be used as the soft material 8 is unwoven cloth with a thickness of about 1.2 mm impregnated with polyurethane.

The spindle 2 is a mechanism which serves both to hold the semiconductor wafer 1 and to impart rotational movement to it. It is provided with a guide ring 3 for the purpose of holding the semiconductor wafer 1 while it is polished, a base plate 4 for the purpose of applying a load to the semiconductor wafer 1, and a back pad 5 which acts as a buffer material in order to control the shape of the semiconductor wafer 1. The guide ring 3 is formed of hard plastic or a similar material, and is set in such a manner that its lower edge does not come into contact with the upper surface of the polish pad 9. The back pad 5 which acts as a buffer material is formed of polyurethane or a similar material with a thickness of about 0.6 mm, and the degree of hardness is set at Shore spring A hardness 72.5 (JIS spring A hardness 70).

Except for the degrees of hardness of the hard material 7 and soft material 8 which form the polish pad 9, the basic structure of this polishing apparatus is the same as conventional ones, and it employs a spindle 2 and platen 6 to match the dimensions and shape of the semiconductor wafer which is to be polished.

With reference to FIGS. 1–4 there now follows a description of the method for polishing semiconductor wafer using a polishing apparatus structured as above.

First, the semiconductor wafer 1 is fitted so as to be in close contact with the lower surface of the back pad 5 of the spindle 2, with the surface on which the semiconductor components are formed facing the upper surface of the polish pad 9. Next, an abrasive agent (not shown in the drawing) is supplied from a mechanism for that purpose on to the upper surface of the polish pad 9, which comprises the hard material 7 and soft material 8 with respective degrees of hardness of Shore spring A hardness 97–98.5 (JIS spring A hardness 95 or thereabouts) and Shore spring A hardness 78–87.5 (JIS spring A hardness 75–85).

The abrasive agent used may be an ordinary one containing about 12% fumed silica adjusted to pH 10–11 by virtue of its KOH content. The flow of the abrasive agent varies according to the structure of the polishing apparatus and the conditions of polishing, but in this example it is in the region of 100–300 cc/min.

Next, the base plate 4 of the spindle 2 presses the semiconductor wafer 1 against the upper surface of the polish pad 9 at a prescribed pressure, and the spindle 2 and platen 6 are rotated in the same direction. The load applied to the semiconductor wafer 1 is set, for instance, in the range 250–750 g/cm$^2$, and their speed of rotation at about 10–50 rpm. It is preferable for the speed if rotation of the spindle 2 and that of the platen 6 to be roughly the same. However, if they are exactly the same, it is advisable to slacken the spindle 2 in one direction or the other. By polishing the semiconductor wafer 1 under conditions of this sort, it is possible to prevent the localised distortion of the hard material 7 of the polish pad 9 which results from the stress exerted by the edge section of the semiconductor wafer 1.

Figure 2:
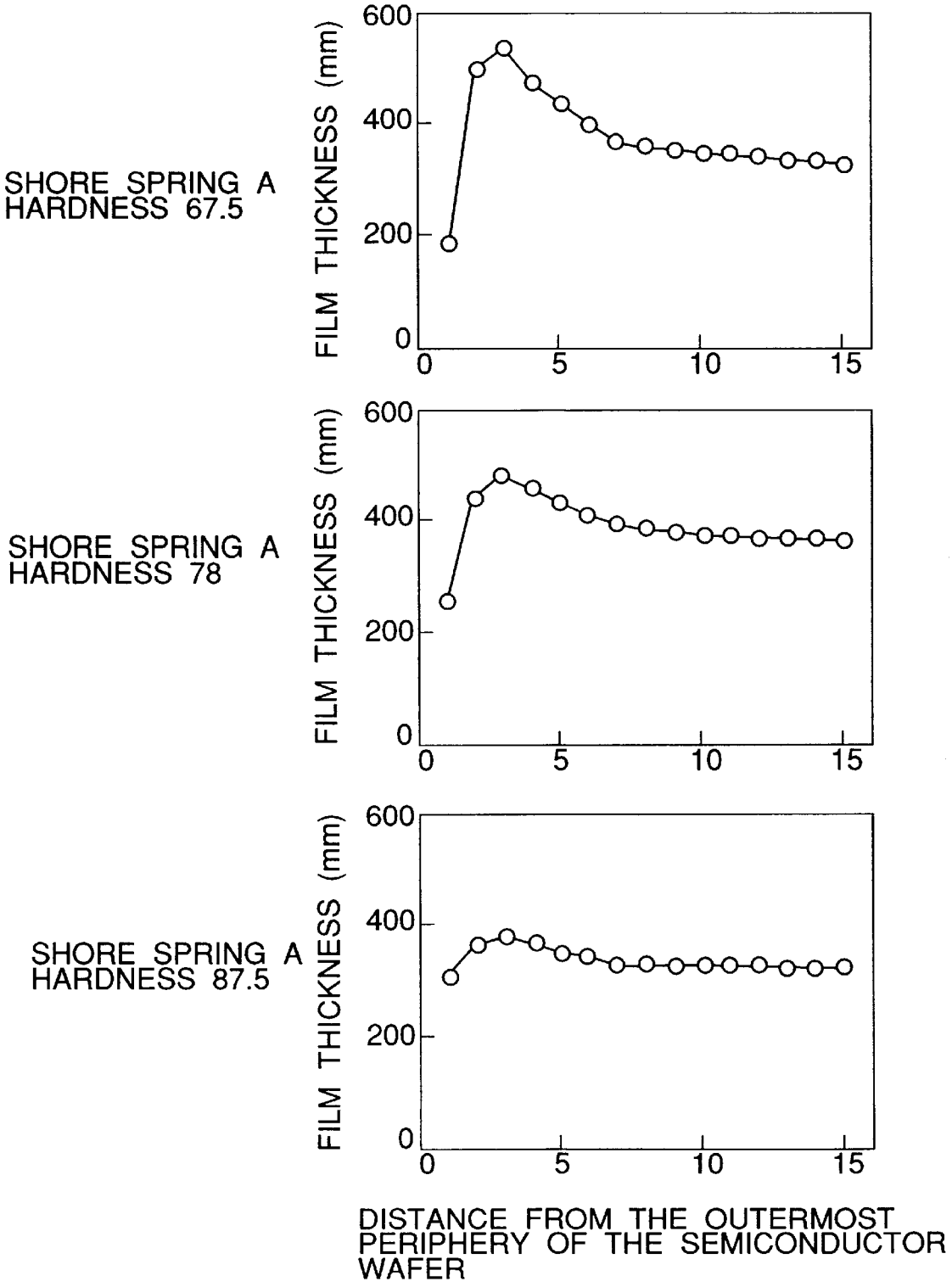
FIG. 2 characterises the relationship between the degree of hardness of the soft material in the polish pad which forms the same embodiment and the distribution of film thickness remaining in the vicinity of the outermost periphery of a semiconductor wafer after completion of polishing.

FIG. 2 characterises the relationship between the degree of hardness of the soft material in the polish pad which forms the same embodiment and the distribution of film thickness remaining within 15 mm of the outermost periphery of a semiconductor wafer after completion of polishing. For the purpose of FIG. 2, the degree of hardness of the hard material 7 of the polish pad 9 has been set at Shore spring A hardness 97–98.5 (JIS spring A hardness 95 or thereabouts). If a material of a conventional degree of hardness, namely Shore spring A hardness 67.5 (JIS spring A hardness 65) is employed as the soft material 8, it will be seen from the drawing that an area of 2–3 nm from the outermost periphery of the semiconductor wafer forms a peak, being in the region of 200 nm thicker than areas of the semiconductor wafer which are further inward. For example, with semiconductor devices of 0.2 $\mu$m rule, the focal depth in the lithography method is 200 nm or less. If the CMP method is applied for the sake of mass-production, it becomes difficult to form semiconductor components in an area within 5–6 mm of the outermost periphery of the semiconductor wafer.

On the other hand, the drawing shows that if a material of Shore spring A hardness 78 (JIS spring A hardness 75), which is within the suitable range of hardness in this example, is employed as the soft material 8, the peak in the vicinity of the outermost periphery of the semiconductor wafer 1 is halved, and it becomes possible to form semiconductor components to within about 2 mm of the outermost periphery of the semiconductor wafer 1. Moreover, if the degree of hardness of the soft material 8 is increased to Shore spring A hardness 87.5 (JIS spring A hardness 85), which is also within the suitable range of hardness in this example, the peak in the vicinity of the outermost periphery of the semiconductor wafer 1 is halved again, and it becomes possible to form semiconductor components to within about 50 nm of the outermost periphery of the semiconductor wafer 1, thus expanding the margin still further.

Figure 3:
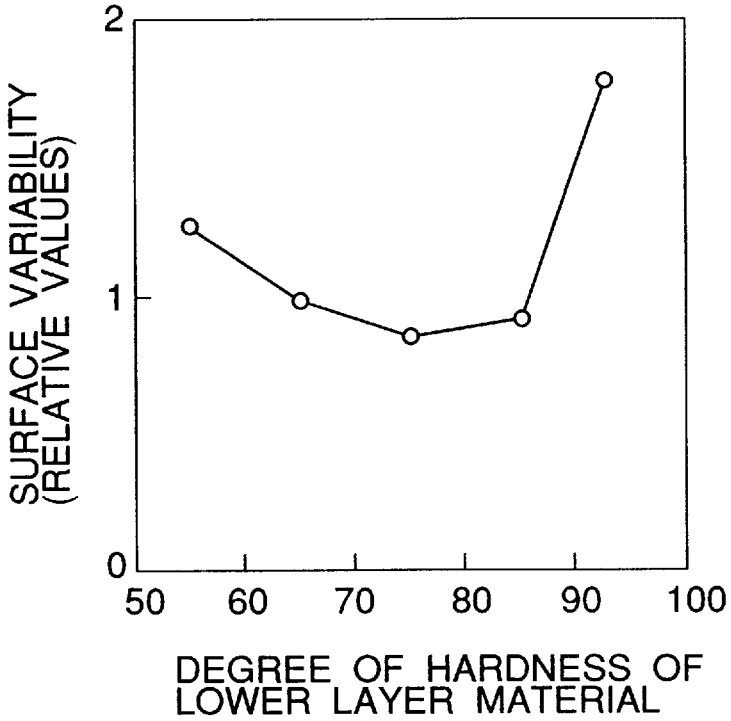
FIG. 3 characterises the relationship between the degree of hardness of the soft material in the polish pad which forms the same embodiment and surface variability in the rate of polishing.

FIG. 3 characterises the relationship between the degree of hardness of the soft material 8 in the polish pad and surface variability in the rate of polishing. It will be seen that there is less surface variability in the rate of polishing, as in this example, in the region of Shore spring A hardness 78–87.5 (JIS spring A hardness 75–85) than at the conventional Shore spring A hardness 57.5–69 (JIS spring A hardness 55–65). If the degree of hardness of the soft material 8 in the polish pad is raised to above Shore spring A hardness 87.5 (JIS spring A hardness 85), it becomes similar to that of the hard material 7 in the polish pad, losing the minimum degree of softness required in the polish pad, with the result that surface uniformity in the rate of polishing deteriorates markedly.

Figure 4:
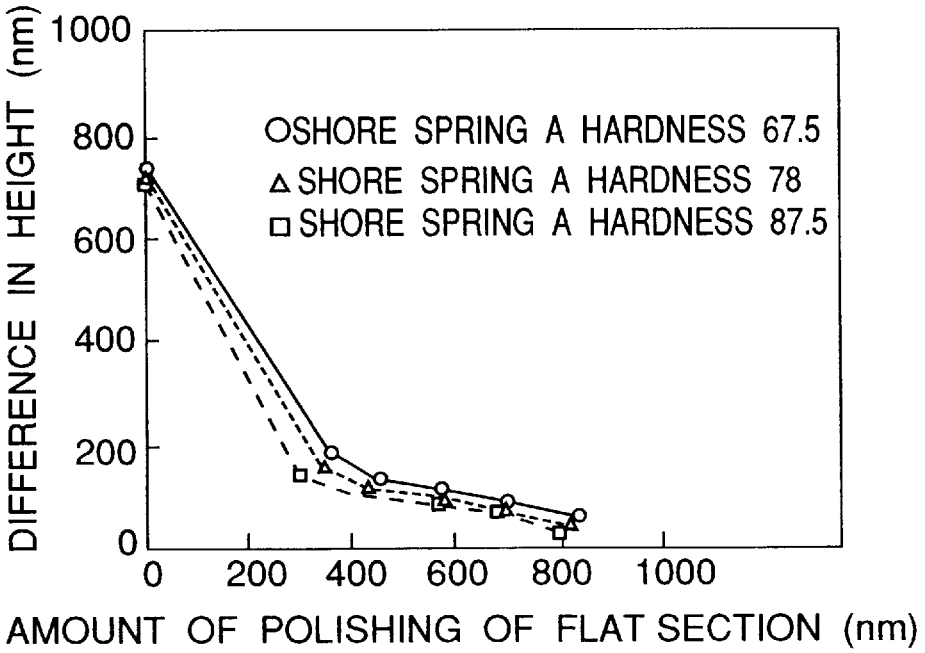
FIG. 4 characterises the relationship between the degree of hardness of the soft material in the polish pad which forms the same embodiment and planarization properties.

FIG. 4 characterises the relationship between the degree of hardness of the soft material and planarization properties. Planarization properties serve as an index which shows how convex patterns of a specified size can be flattened selectively without polishing the flat sections. As will be seen from FIG. 4, where the amount of polishing of flat sections in the semiconductor wafer 1 is the same, planarization properties improve in inverse proportion to the difference in height. An increased degree of hardness of the soft material 8 in the polish pad results in improved planarization properties.

An overall assessment of the above shows distribution of film thickness, surface uniformity of rate of polishing and planarization properties to be superior in areas where the degree of hardness of the soft material 8 in the polish pad 9 is Shore spring A hardness 78–87.5 (JIS spring A hardness 75–85) than where it is the conventional Shore spring A hardness 57.5–69 (JIS spring A hardness 55–65). In other words, it is possible to improve the distribution of film thickness in the vicinity of the outermost periphery of the semiconductor wafer 1, and thereby not only to create semiconductor components closer to the periphery of the semiconductor wafer 1, but also to improve surface uniformity of the rate of polishing and planarization properties.

In this way, the fact that the configuration of this example allows the degree of hardness of the soft material 8 which forms the lower layer of the polish pad 9 to be set higher than hitherto at Shore spring A hardness 78–87.5 (JIS spring A hardness 75–85) makes it possible to inhibit localised distortion of the hard material 7 of the polish pad 9 which results from the stress exerted by the outermost periphery section of the semiconductor wafer 1. Consequently it becomes feasible to equalise the rate of polishing in the peripheral section of the semiconductor wafer 1 to that in the vicinity of the center thereof. As a result, it becomes possible to create semiconductor components closer to the outermost periphery of the semiconductor wafer 1, namely to within a distance of about 2 mm of the outermost periphery, where this has hitherto been impossible within an area of (for instance) 6 mm thereof, thus increasing the effective number of semiconductor chips per semiconductor wafer, and permitting increased productivity.

Moreover, as has been explained above, by setting the degree of hardness of the lower layer material of the polish pad higher than hitherto at Shore spring A hardness 78–87.5 (JIS spring A hardness 75–85), thus inhibiting the phenomenon whereby the upper layer material is subject to localised distortion as a result of the load which is placed upon it by the patterns and convex portions of the semiconductor wafer, it is possible to improve the planarization properties of the semiconductor wafer 1. This means that the amount of polishing of the semiconductor wafer 1 can be reduced, permitting of further increased productivity.

<Second Embodiment>

There follows a description of a second embodiment of the present invention.

As in the foregoing first embodiment, the apparatus for polishing semiconductor device to which this example pertains is configured in such a manner that it has a spindle 2 which serves both to hold the semiconductor wafer 1 and to impart rotational movement to it, and a polish pad 9, which comprises a hard material 7 and a soft material 8 attached to a platen 6 in such a manner as to overlie one another. The spindle 2 is provided with a guide ring 3 for the purpose of holding the semiconductor wafer 1 while it is polished, a base plate 4 for the purpose of applying a load to the semiconductor wafer 1, and a back pad 5 which acts as a buffer material in order to control the shape of the semiconductor wafer 1 (cf. FIG. 1).

A characteristic of this second embodiment lies in the fact that it employs a softer back pad 5 than hitherto in place of the one used in the first embodiment, which at Shore spring A hardness 72.5 (JIS spring A hardness 70) was similar to conventional back pads. In other words, the second embodiment employs for the back pad a material of Shore spring A hardness 62.5–67.5 (JIS spring A hardness 60–65).

By using a softer material than hitherto for the back pad 5, the second embodiment allows the edge of the semiconductor wafer 1 to absorb the reaction force from the polish pad 9. As a result it is possible to attain an even better distribution of film thickness in the vicinity of the outermost periphery of the semiconductor wafer 1 than with the first embodiment.

Figure 5:
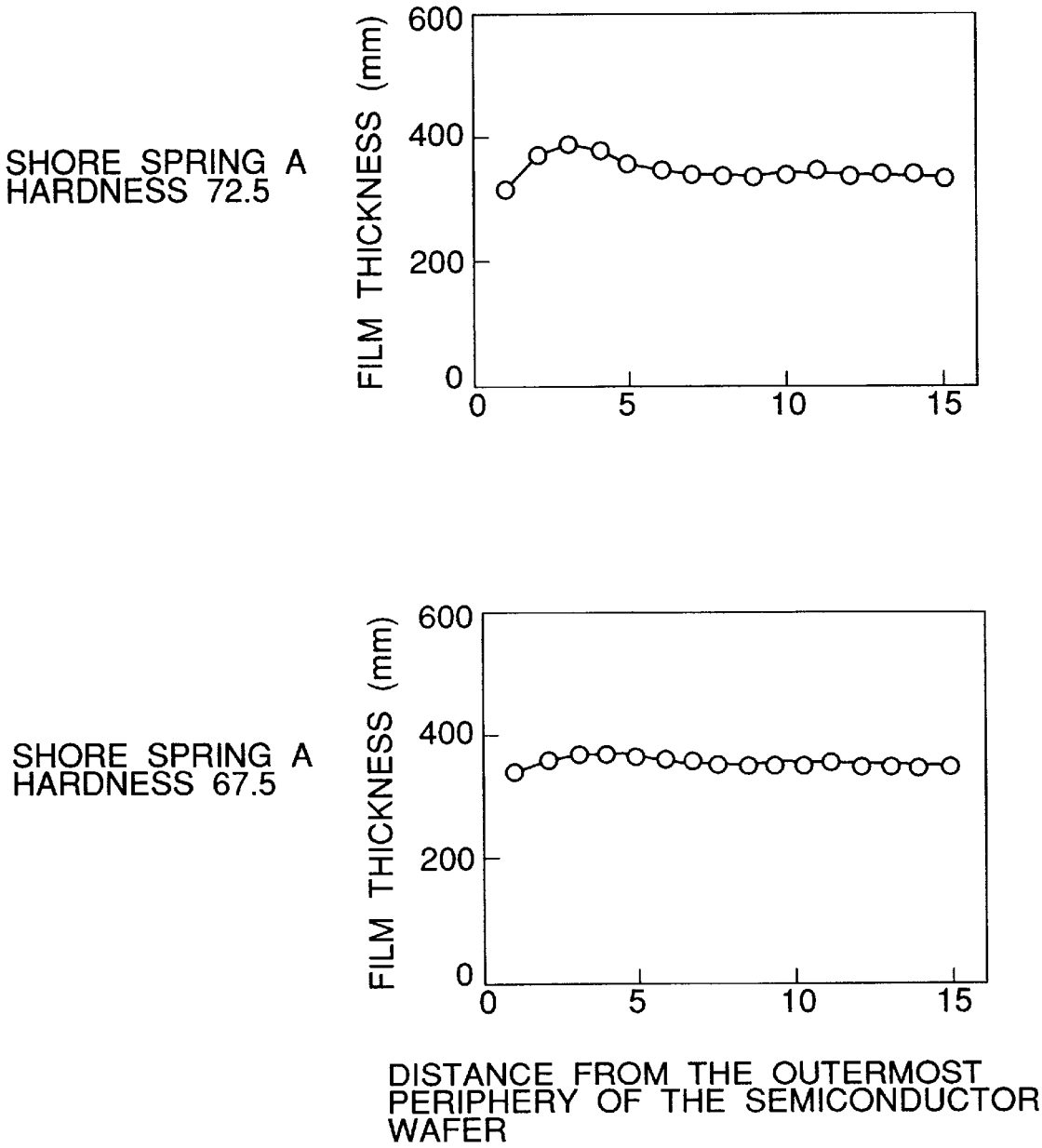
FIG. 5 characterises the relationship between the degree of hardness of the back pad which forms a second embodiment of the present invention and the distribution of film thickness remaining in the vicinity of the outermost periphery of a semiconductor wafer after completion of polishing.
Figure 6:
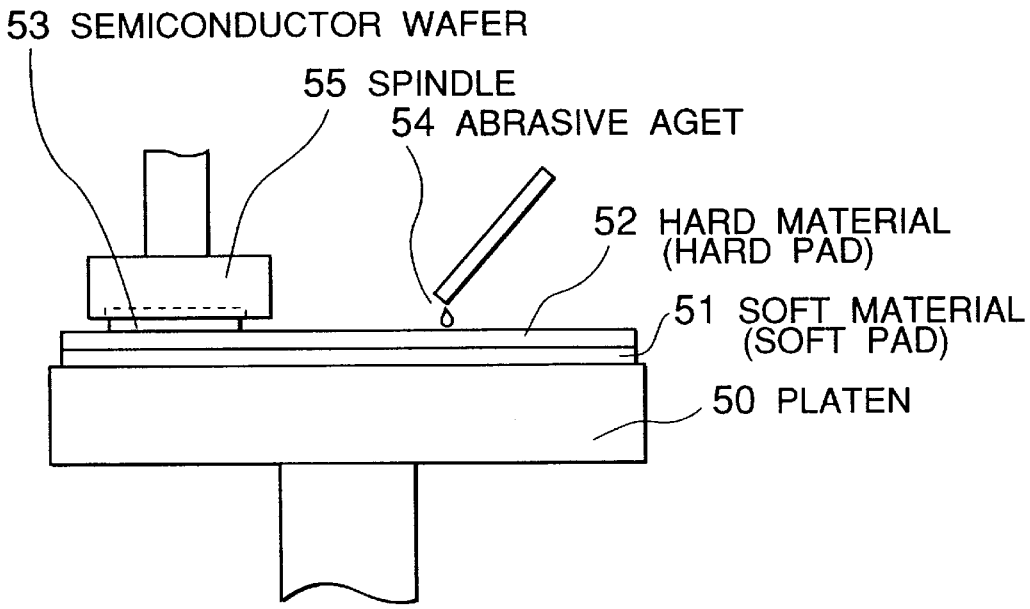
FIG. 6 (PRIOR ART)
FIG. 6 is an outline plan of a conventional apparatus for polishing semiconductors.
Figure 7:
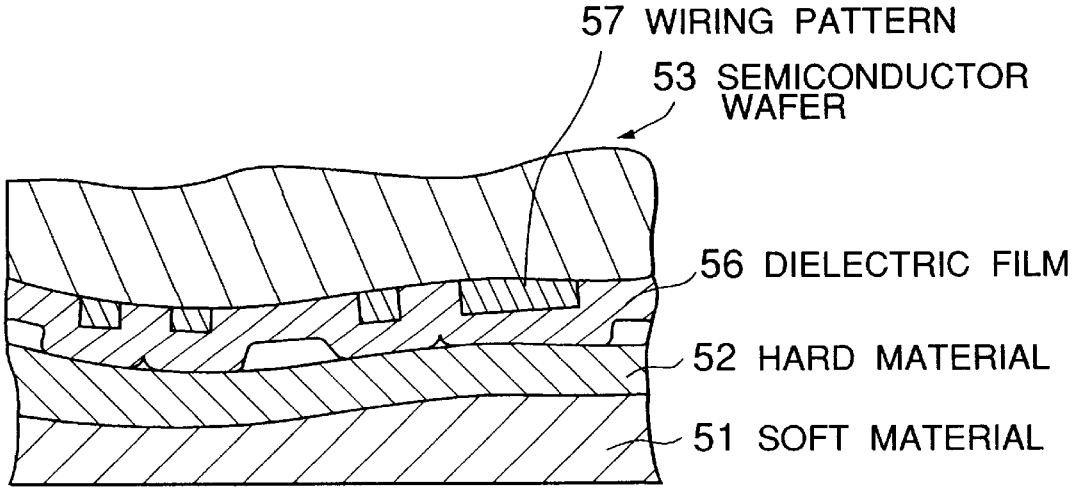
FIG. 7 (PRIOR ART)
FIG. 7 is a drawing which illustrates the conventional method for polishing a semiconductor wafer.
Figure 8:
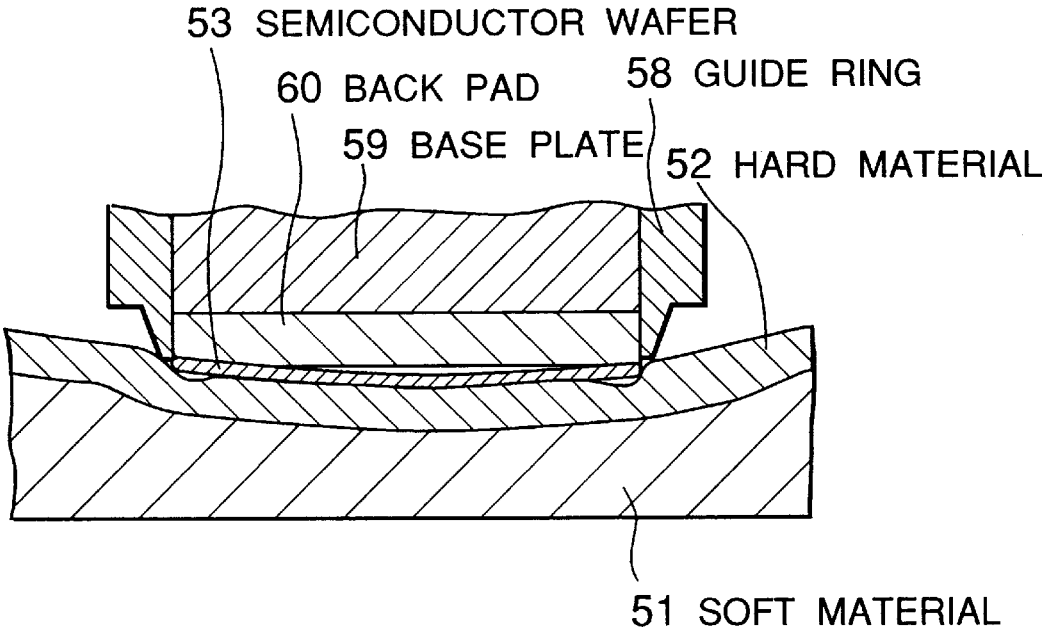
FIG. 8(PRIOR ART)
FIG. 8 is a drawing which illustrates the conventional method for polishing a semiconductor wafer.
Figure 9:
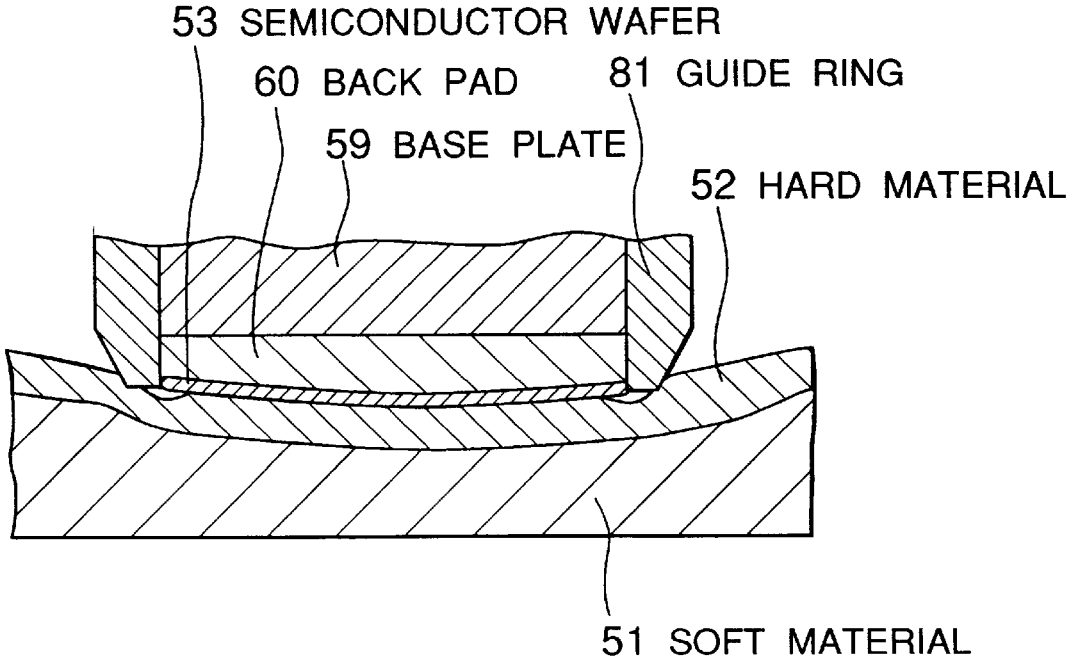
FIG. 9(PRIOR ART)
FIG. 9 is a drawing which illustrates a variation on the conventional method for polishing a semiconductor wafer.
Figure 10:
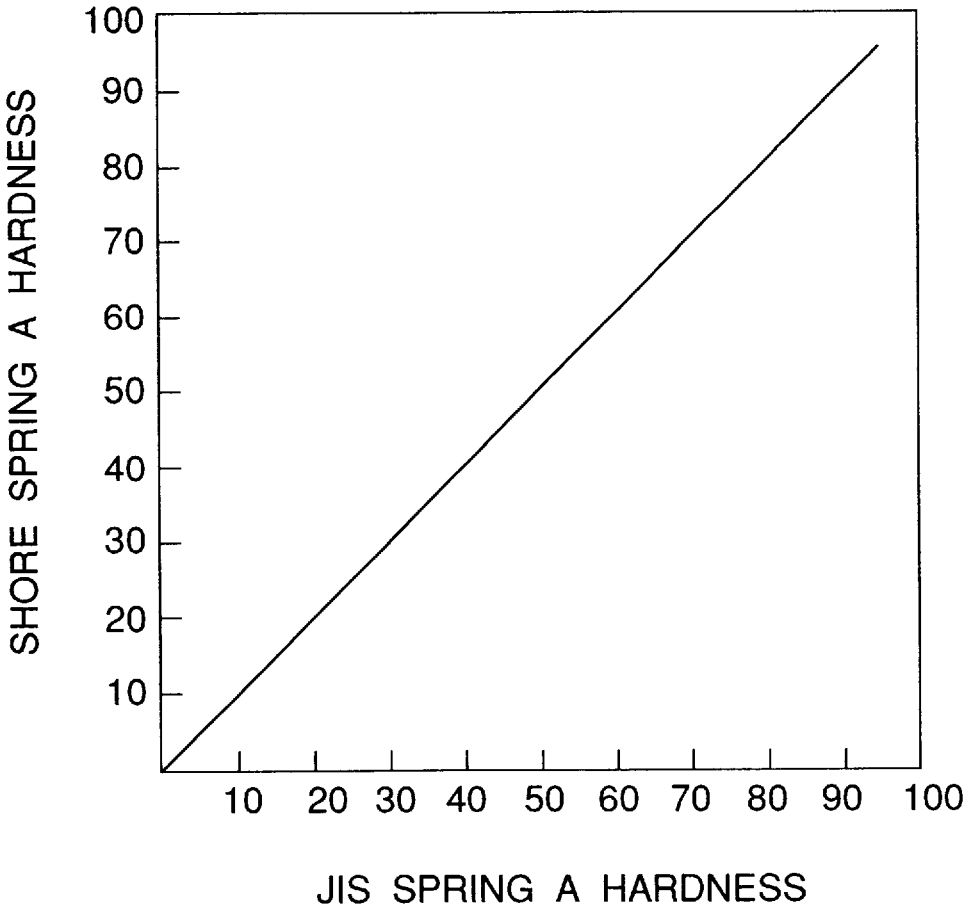
FIG. 10 is a graph which clarifies the relationship between JIS spring A hardness and Shore spring A hardness.

FIG. 5 characterises the relationship between the degree of hardness of the back pad which forms the second embodiment of the present invention and the distribution of film thickness remaining in the vicinity of the outermost periphery of a semiconductor wafer after completion of polishing. The data shown apply where the hard material 7 which constitutes the upper layer of the polish pad 9 is Shore spring A hardness 97–98.5 (JIS spring A hardness 95 or thereabouts), while the soft material 8 which constitutes the lower layer of the polish pad 9 is Shore spring A hardness 87.5 (JIS spring A hardness 85). Because the degree of hardness of the conventional back pad is in the region of Shore spring A hardness 72.5 (JIS spring A hardness 70) variations occur in the distribution of film thickness in the vicinity of the edges. In this second embodiment, however, a softer material of Shore spring A hardness 62.5–67.5 (JIS spring A hardness 60–65) is used for the back pad 5, yielding a better distribution of film thickness as may be seen from the drawing.

In this way, the fact that this second embodiment employs a softer material than hitherto for the back pad 5 which controls the shape of the semiconductor wafer 1 means that it is possible for the edge of the semiconductor wafer 1 to absorb the reaction force from the polish pad 9. As a result it is possible to attain an even better distribution of film thickness in the vicinity of the outermost periphery of the semiconductor wafer 1 than with the first embodiment.

The above is a detailed description of two embodiments of the present invention with the aid of drawings. The configuration is not limited to these embodiments, and any alterations to the design which do not deviate from the essential purport of the present invention are deemed to be included within it. For instance, the foregoing embodiments have employed foamed polyurethane with a thickness of about 1.3 mm as the hard material 7, and unwoven cloth with a thickness of about 1.2 mm impregnated with polyurethane as the soft material 8, but there is no reason to be restricted to these. The hard material (such as Foamed polyurethane) with a thickness of 0.5–2.5 mm is desirable as the upper layer material. Similarly, the soft material (such as unwoven cloth impregnated with polyurethane) with a thickness of 0.5–2.5 mm is desirable as the lower layer material.

In the same way, they have employed polyurethane with a thickness of about 0.6 mm as the back pad 5, but there is no reason to be restricted to this. The buffer material (such as polyurethane) with a thickness of 0.1–1.2 mm is desirable as the back pad.

The abrasive agent used was an ordinary one containing about 12% fumed silica adjusted to pH 10–11 by virtue of its KOH content, and the flow of the abrasive agent was in the region of 100–300 cc/min, but there is no reason to be restricted to this.

Moreover, in the foregoing embodiments a material of Shore spring A hardness 97–98.5 has been used as the hard material 7, but a material of Shore spring A hardness 92–98.5 may been used as the desirable hard material 7.

Similarly, in the foregoing embodiments a material of Shore spring A hardness 62.5–67.5 has been used as the back pad 5, but a material of Shore spring A hardness 40–70 may been used as the desirable back pad 5.

It is thus apparent that the present invention is not limited to the above embodiments but may be changed and modified without departing from the scope and spirit of the invention.

What is claimed is:

1. A method for polishing a semiconductor device, whereby a semiconductor wafer is polished while being pressed against a polish pad which comprises:

an upper layer material; and a lower layer material of differing degrees of hardness overlying one another, wherein the degree of hardness of the upper layer material of said polish pad is set at Shore spring A hardness 92–98.5, and the degree of hardness of the lower layer material of said polish pad at Shore spring A hardness 78–87.5.

2. A method according to claim 1, wherein polishing is executed with a buffer material of Shore spring A hardness 40–70 located between a means of applying a load to said semiconductor wafer and said semiconductor wafer itself.

3. A method according to claim 1, wherein said hard material is foamed polyurethane of a specified thickness.

4. A method according to claim 1, wherein said soft material is unwoven cloth impregnated with polyurethane.

5. A method according to claim 1, wherein said buffer material is polyurethane of a specified thickness.

6. A method according to claim 1, wherein an abrasive agent is fed on to the upper surface of said polish pad, during which time said semiconductor wafer is polished while being pressed against said polish pad which comprises said upper layer material and said lower layer material of differing degrees of hardness overlying one another.

7. A method according to claim 6, wherein said abrasive agent is fumed silica adjusted to pH 10–11 by virtue of its KOH content.

8. An apparatus for polishing a semiconductor wafer, equipped with a polish pad comprising:

an upper layer material; and a lower layer material of differing degrees of hardness overlying one another, said semiconductor wafer being polished while being pressed against said polish pad, wherein the degree of hardness of the upper layer material of the polish pad is set at Shore spring A hardness 92–98.5, and the degree of hardness of the lower layer material of the polish pad at Shore spring A hardness 78–87.5.

9. An apparatus according to claim 8, wherein a buffer material of Shore spring A hardness 40–70 is located between a means of applying a load to the semiconductor wafer and said semiconductor wafer itself.

10. An apparatus according to claim 8, wherein said hard material is foamed polyurethane of a specified thickness.

11. An apparatus according to claim 8, wherein said soft material is unwoven cloth impregnated with polyurethane.

12. An apparatus for polishing semiconductor device according to claim 8, wherein said buffer material is polyurethane of a specified thickness.

* * * * *